US005695835A

United States Patent [19]

Weber et al.

[11] Patent Number: 5,695,835

[45] Date of Patent: Dec. 9, 1997

[54] MULTI DIMENSIONAL CAMOUFLAGED GARMENT

[76] Inventors: Daniel J. Weber; Marlene Weber, both of 911 Highway 29 North, Alexandria, Minn. 56308

[21] Appl. No.: 648,547

[22] Filed: May 16, 1996

Related U.S. Application Data

[60] Provisional application No. 60/001,574 Jul. 27, 1995.

[51] Int. Cl.[6] ..... F41H 3/00

[52] U.S. Cl. ..... 428/17; 2/94; 2/900; 428/919

[58] Field of Search ..... 428/15, 17, 919; 2/94, 900

[56] References Cited

U.S. PATENT DOCUMENTS

| | | | |
|---|---|---|---|
| 3,069,796 | 12/1962 | Ruter | 428/17 |
| 4,323,605 | 4/1982 | Rush | 428/919 X |
| 4,375,488 | 3/1983 | Hogan | 428/919 X |
| 4,517,230 | 5/1985 | Crawford | 428/919 X |
| 4,656,065 | 4/1987 | Yacovella | 428/17 |
| 4,931,320 | 6/1990 | Leonard | 428/17 |
| 4,940,619 | 7/1990 | Smith, Jr. et al. | 428/919 X |
| 5,013,375 | 5/1991 | Leonard | 428/17 X |
| 5,445,863 | 8/1995 | Slagle et al. | 428/17 X |

*Primary Examiner*—Henry F. Epstein
*Attorney, Agent, or Firm*—Patterson & Keough, P.A.

[57] ABSTRACT

A multi-dimensional camouflaged garment that has an external surface, a first portion of the external surface being formed of a three dimensional material and a second portion of the external surface being formed of a two dimensional material.

10 Claims, 4 Drawing Sheets

MULTI DIMENSIONAL CAMOUFLAGED GARMENT

RELATED APPLICATION

The present patent application is based on Provisional Patent Application 60/001,574 filed on Jul. 27, 1995, which Provisional Patent Application is incorporated herein in its entirety by reference.

TECHNICAL FIELD

The present invention is directed to camouflaged garment to be used by bowhunters. More particularly, the garment is formed of a two dimensional fabric on the front facing portion of the arms and the chest of the garment, while the remainder of the garment is formed of a three dimensional camouflaged material.

BACKGROUND OF THE INVENTION

Camouflaged material has long been employed to conceal personnel from visual detection by causing the wearer to blend into the background as presented by the local terrain. Camouflaged materials can be generally divided into two different categories. The first such category are two dimensional materials, having height and width and having a generally negligible thickness dimension in comparison to the height and width dimensions thereof. Such materials may be woven or nonwoven and may be of solid color or dyed or printed in multiple color patterns to simulate the coloration of the terrain in which the camouflaged material is used.

A second type of material may be characterized as having a three dimensional design which offers depth and dimension that is apart from the thickness of the material used. An advantage of three dimensional material is that it tends to break up the outline of the camouflaged object when viewed from a distance. Such material is typically made to look, act and move like natural foliage, especially the natural foliage in which the wearer expects to wear the camouflaged material. The three dimensional material may be looped, leafed, frayed or cut fabric to create the three dimensional effect. U.S. Pat. Nos. 3,069,796, 4,323,605, and 4,375,488 disclose a camouflaged material consisting of flexible sheets in which a pattern of cuts is made to provide holes and flaps simulating pieces of variously colored foliage. U.S. Pat. No. 4,493,863 discloses laminated camouflage sheet in which the exterior layer is die cut by stamping apparatus to form arcuate slits which form tongues to curl outwardly from the plane of the camouflage sheet.

U.S. Pat. No. 4,931,320 discloses a camouflage material having a net substrate which is bonded a sheet material, such as woven fabric. A sheet is colored to a desired camouflage pattern and bonded to the substrate along space lines of attachment. The sheet is cut to simulate the appearance of natural objects of a terrain, such as leaves of foliage, between adjacent lines of bonding to the net substrate. A further three dimensional camouflage material has a net backing with a cut facing layer attached thereto and marketed under the trade name Bushy Ridge by Teledyne Brown Engineering, Jackson, Ala. 36545.

Both the two dimensional and three dimensional camouflaged material have been utilized to construct camouflaged garments for use by hunters and photographers. The three dimensional material is particularly effective in concealing the wearer due to the fact that the fabric is made to look, act and move as natural foliage.

It is a concern by bowhunters in using garments constructed of three dimensional camouflage material that such material may become entangled with the moving portions of the bow, as for example the strings and cams of a compound bow, when the bowstring of the compound bow is drawn. Such entanglement poses a safety hazard to the bowhunter and others upon release of the drawn bow. The arrow may be deflected from its intended path of travel by the entanglement, resulting in injury to others. The bowhunter's apparel may be violently torn by the entanglement, resulting in injury to the bowhunter.

There is a need in the industry for garment to be worn by a bowhunter that affords the bowhunter the improved concealment characteristic of camouflaged material that is three dimensional and at the same time minimizes the possibility that the material of the garment will become entangled in the bow components as the bow is drawn and released.

SUMMARY OF THE INVENTION

The present invention substantially meets the aforementioned needs. The front facing portion of the two arms of the garment and the chest portion of the garment are formed of two dimensional camouflaged material. Substantially the entire remainder of the garment is formed of a three dimensional camouflaged material. Preferably, the color pattern imposed on the two dimensional camouflaged material matches the color pattern imposed on the three dimensional material.

The invention is a multi-dimensional camouflaged garment that has an external surface, a first portion of the external surface being formed of a three dimensional material and a second portion of the external surface being formed of a two dimensional material.

DETAILED DESCRIPTION OF THE DRAWINGS

Figure 1:
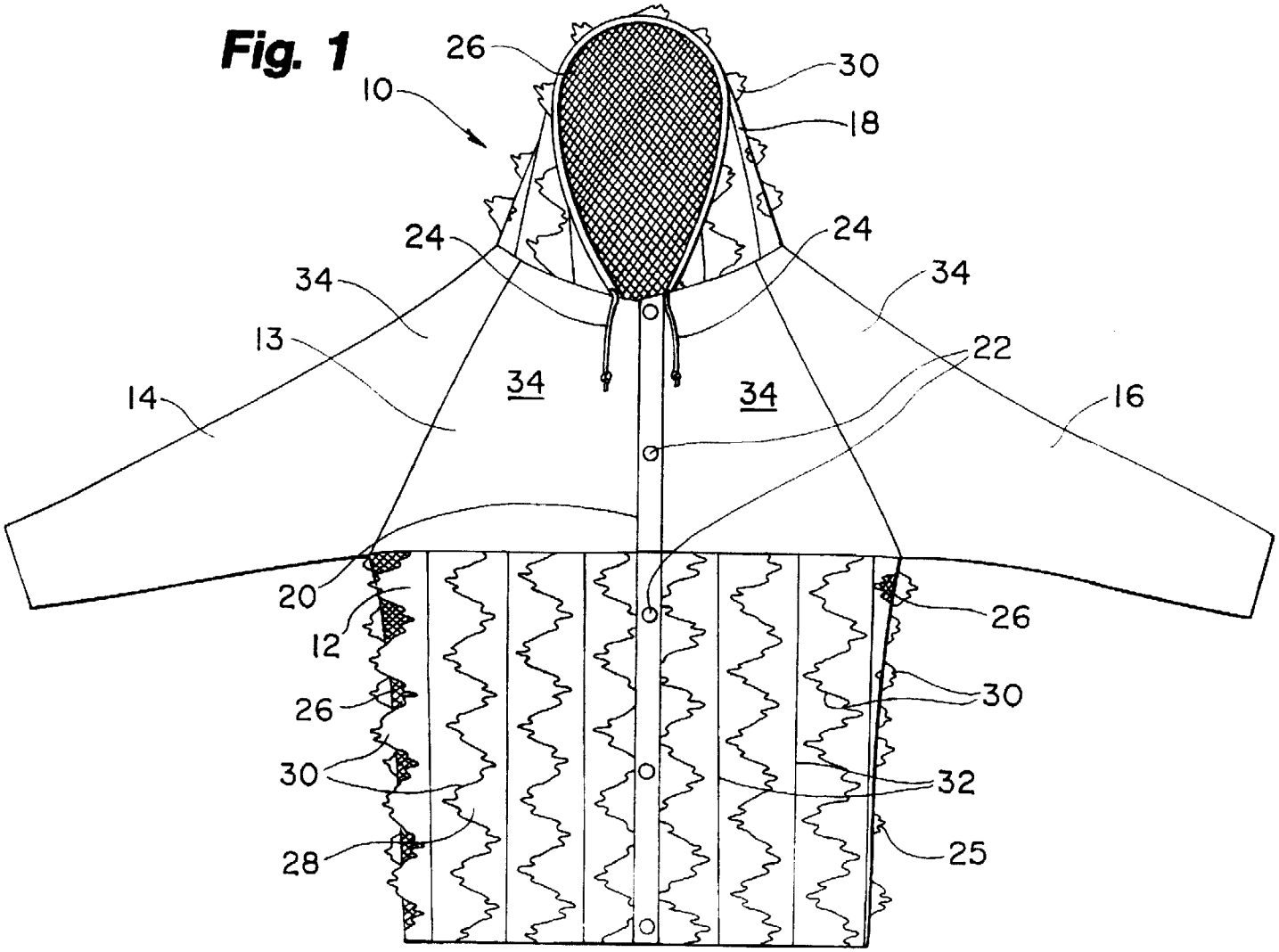
FIG. 1 is a front elevational view of a multi-dimensional camouflaged garment made according to the present invention.
Figure 2B:
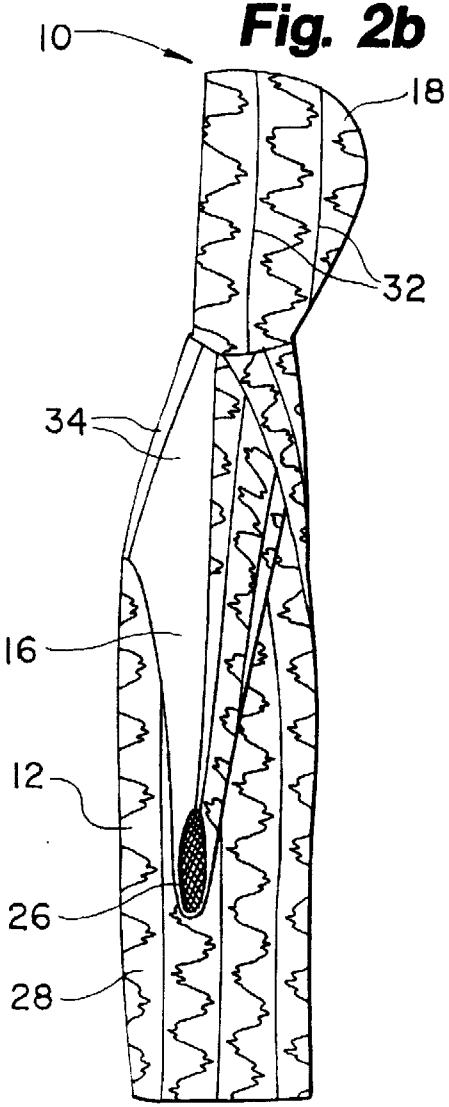
FIG. 2*b* is a left side elevational view of the multi-dimensional camouflaged garment.
Figure 2A:
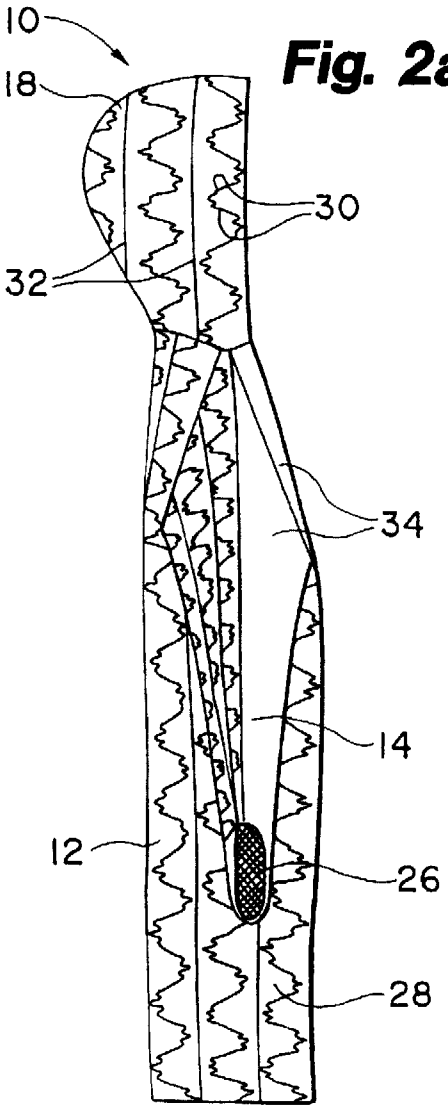
FIG. 2*a* is a right side elevational view of the multi-dimensional camouflaged garment.
Figure 3:
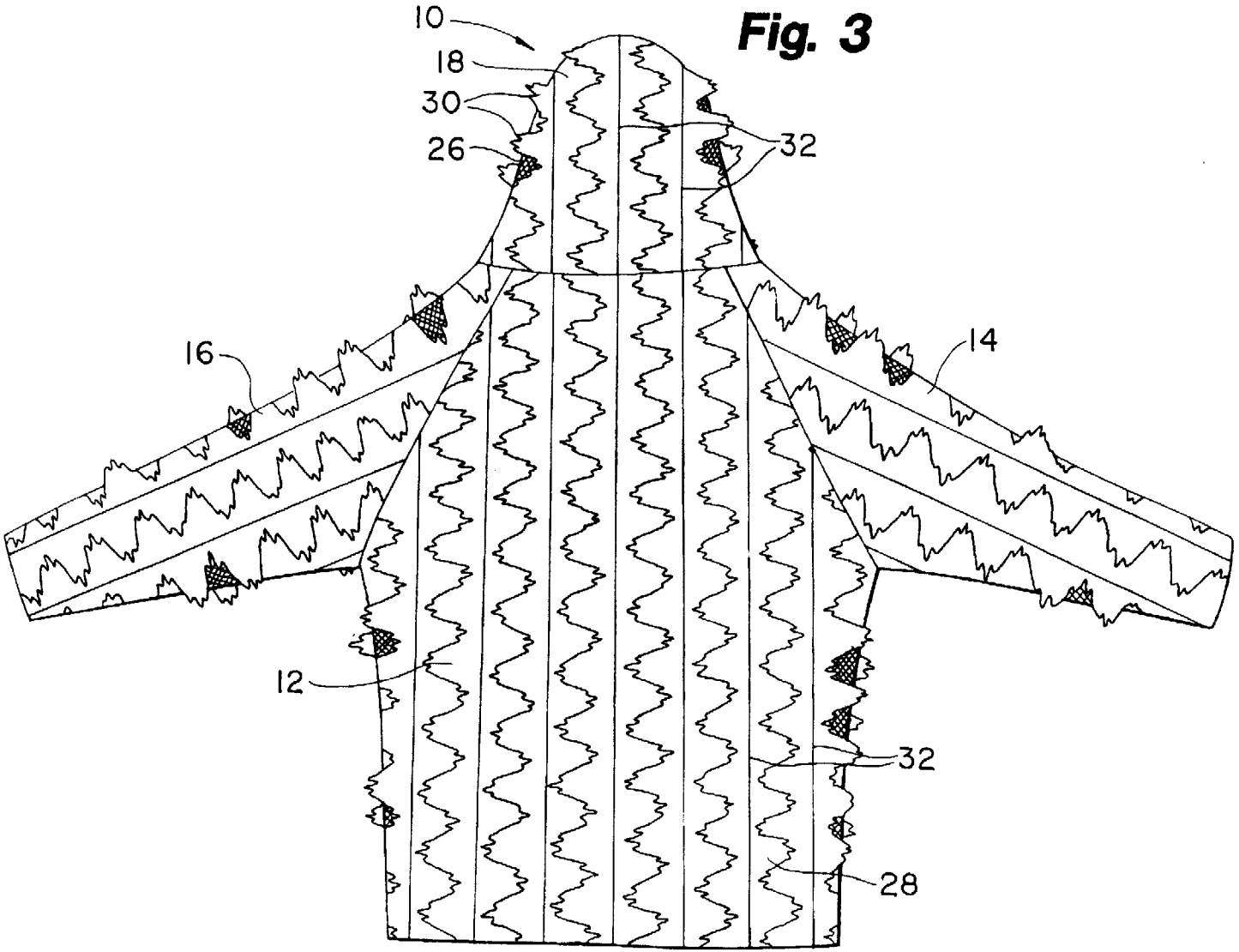
FIG. 3 is a rear elevational view of the multi-dimensional camouflaged garment.

A multi-dimensional camouflaged garment made according to the present invention is shown generally at 10 in FIGS. 1–3. The multi-dimensional camouflaged garment 10 as depicted in FIGS. 1–3 is in the form of a waist length jacket. Additional garment forms can be used such as, for example, a coat, parka or poncho style garment.

The multi-dimensional camouflaged garment 10 is comprised of a torso 12, a right arm 14, a left arm 16, and a hood 18.

The torso 12 of the multi-dimensional camouflaged garment 10 has a front opening 20 and a plurality of snap closures 22. It is understood that other means of closure may also be used, as for example hook and pile, zipper and buttons. A hood 18 is provided to partially conceal the head of the wearer The hood 18 has a drawstring 24 for fitting the hood 18 to the face of the wearer. he multi-dimensional camouflaged garment 10 may be produced with or without a hood 18. The hood 18 may be permanently attached to the garment 10 or may be readily detachable therefrom.

In the embodiments shown, the three dimensional material 25 utilized to form the multi-dimensional camouflaged garment 10 is of the type disclosed in U.S. Pat. No. 4,931,320. As depicted in FIGS. 1–3, the three dimensional camouflaged material 25 is utilized to form the lower front portion of the torso 12, the rear portion of the torso 12, the rear facing portion of the right arm 14 and left arm 16, and the hood 18. It is desirable to use the maximum amount of three dimensional material 25 consistent with the objective of ensuring the safety of the wearer and others when certain instrumentalities are used by the wearer in order to maximize the increased concealment afforded by the three dimensional material. In some cases it may be desirable that the entire front facing portion of the torso 12 of the garment 10 be devoid of the three dimensional material 25. It should be noted that while the three dimensional camouflaged material 25 shown is as disclosed in the '320 patent, other three dimensional camouflaged materials may be used in the formation of the aforementioned portions of the multi-dimensional camouflaged garment 10.

The three dimensional material 25 depicted is formed on a mesh substrate 26. A cut facing layer 28 has a plurality of lobes 30 and is bonded to the mesh substrate 26 by stitch bonding 32. The lobes 30 are free of the mesh substrate 26 on either side of the stitch bonding 32 and are free to respond to breezes much as natural leaves and other foliage does.

Two dimensional camouflaged material 34 is utilized to form the exterior surface of the multi-dimensional camouflaged garment 10 that comprises the forward facing portions of the right arm 14 and the forward facing portions of left arm 16 and the right and left portions of the chest area 13 of the torso 12. Preferably, a matching colored camouflaged pattern is imposed on both the two dimensional material 34 and the cut facing layer 28 of the three dimensional material 25. Another way of achieving a two dimensional material is to sew down, cut off, or in any way alter, the leaves of three dimensional fabric.

Figure 4:
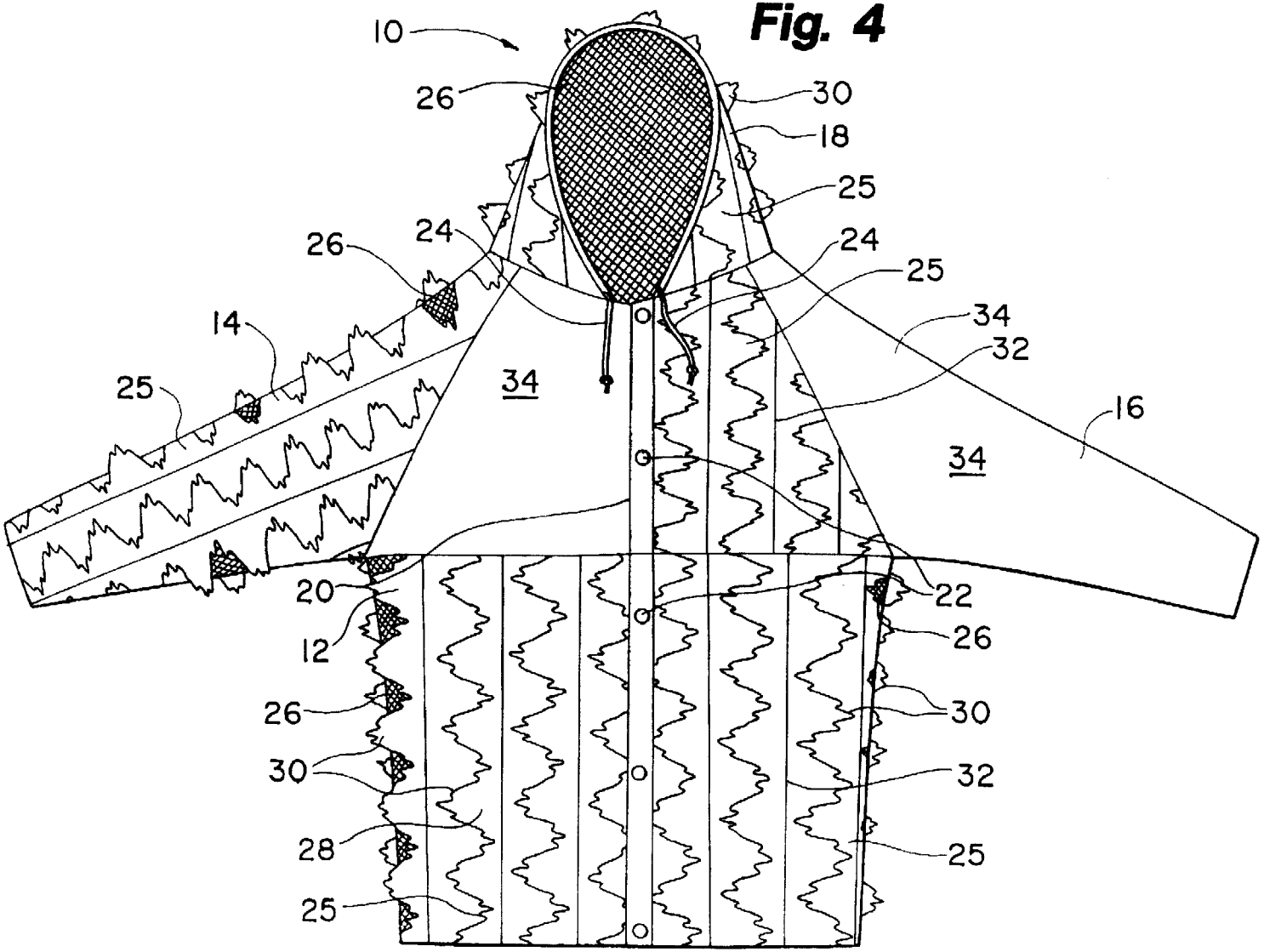
FIG. 4 is a front elevational view of a multi-dimensional camouflaged garment made according to the present invention adapted for use by a right handed bowhunter.

As stated, it is desirable to use the maximum amount of three dimensional material consistent with the objective of ensuring the safety of the wearer and others when certain instrumentalities are used by the wearer in order to maximize the improved concealment afforded by the three dimensional material. Accordingly, FIG. 4 presents an alternative preferred embodiment of the multidimensional camouflaged garment 10 that is adapted specifically for use by right handed bowhunters. As previously indicated, the bow string of a bow when drawn and released by a right handed archer comes closest to the right chest and the left forward facing arm portions of the apparel worn by the archer. The bow string is the primary instrumentality that must be kept away from the three dimensional material. Only the right chest portion of the torso 12 and the forward facing portion of the left arm 16 of the multi-dimensional camouflaged garment 10 have the external surface made of two dimensional material 34.

Consistent with the above, a multi-dimensional camouflaged garment 10 adapted for use by a left handed archer may be made in accordance with the same object by using the two dimensional camouflaged material 34 for only the left chest portion of the torso 12 and the forward facing portion of the right arm 14 of the multi-dimensional camouflaged garment 10 have the external surface made of two dimensional material 34.

The mesh substrate 26 of the depicted three dimensional material 25 results in the garment 10 being light weight and airy. It is understood that multidimensional camouflaged garments 10 made in accord with the present invention may be lined or unlined as desired to adapt the garment 10 for use in a wide range of temperatures. Further, the garment 10 may have a lining of waterproof material or water resistant semi-permeable material to adapt the garment 10 for use in inclement weather.

In operation, a right handed bow hunter supports the bow in the left hand and draws the bow string to a position close to the bow hunters face with the right hand. In the drawn position, the bow string is in close proximity to the right side of the chest with the bow hunter. Upon release of the bow string, the bow string travels at very high speed in close proximity to the front facing portion of the bowhunter's left arm. The substantially uninterrupted two dimensional material 34 forms the chest area of torso 12 in the front facing portion of the left arm 16 presents a surface to the bow string having little likelihood of becoming entangled therewith. The forward facing portion of the right arm 14 of the multi-dimensional camouflaged garment 10 affords similar protection to a left handed bow hunter.

What is claimed is:

1. A multi-dimensional camouflaged garment, the garment serving to camouflage a wearer thereof by presenting an external appearance to an observer that tends to be indistinguishable from the environmental features against which the wearer is observed, comprising:

a garment external surface, being viewable by an observer and having a first portion and a second portion;

the first portion of the garment external surface being formed of a substantially three dimensional material; and the second portion of the garment external surface being formed of a substantially two dimensional material.

2. A multi-dimensional camouflaged garment as claimed in claim 1 wherein the garment is adapted for use by a wearer employing a selected instrumentality, the second portion of the garment external surface being disposed where said instrumentality is most likely to contact the garment during employment thereof by the wearer thereby minimizing contact between the instrumentality and the three dimensional material forming the first portion of the external surface, which three dimensional material may become entangled with said instrumentality.

3. A multi-dimensional camouflaged garment as claimed in claim 1 wherein the garment has at least a torso, the torso having a chest portion, and a left and a right arm, the left and right arms each having a forward facing portion and a rear facing portion, the chest portion of the torso and the forward facing portions of the arms being the second portion of the garment external surface.

4. A multi-dimensional camouflaged garment as claimed in claim 1, wherein the garment has at least a torso, the torso having a chest portion, and a left and a right arm, the left and right arms each having a forward facing portion and a rear facing portion, the right chest portion of the torso and the forward facing portion of the left arm being the second portion of the garment external surface.

5. A multi-dimensional camouflaged garment as claimed in claim 1, wherein the garment has at least a torso, the torso having a chest portion, and a left and a right arm, the left and right arms each having a forward facing portion and a rear facing portion, the left chest portion of the torso and the forward facing portion of the right arm being the second portion of the garment external surface.

6. A multi-dimensional camouflaged garment as claimed in claim 1, wherein the two dimensional material and the three dimensional material have substantially similar camouflage colors and patterns imposed thereon.

7. A camouflaged garment to be worn by an archer, the garment substantially covering at least the torso and arms of the archer, the torso having at least a forward facing chest portion and each of the arms having a forward facing portion and a rearward facing portion, the garment serving to camouflage the archer by presenting an external appearance to an observer that tends to be indistinguishable from the environmental features against which the archer is observed, comprising:

a multi-dimensional camouflaged garment exterior surface having a first portion and a second portion;

the garment exterior surface first portion being formed of a two dimensional material, the two dimensional material forming the exterior surface of the garment substantially covering at least one forward facing arm portion and at least one half of the forward facing chest portion of the torso of the archer; and the garment exterior surface second portion being formed of a three dimensional material.

8. The camouflaged garment as claimed in claim 7 wherein the garment exterior surface first portion covers a right chest portion of the torso and the forward facing portion of the left arm.

9. The camouflaged garment claimed in claim 7 wherein the garment exterior surface first portion covers a left chest portion of the torso and the forward facing portion of the right arm.

10. The camouflaged garment as claimed in claim 7, wherein the camouflaged garment exterior surface first portion and second portion have substantially similar camouflage colors and patterns imposed thereon.

* * * * *